US005156479A

United States Patent [19]

Iizuka

[11] Patent Number: 5,156,479

[45] Date of Patent: Oct. 20, 1992

[54] COSMETIC APPLICATOR BRUSH HAVING A RESERVOIR AND INSULATED, PRESSURIZED CHAMBER

[75] Inventor: Shigeo Iizuka, Funabashi, Japan

[73] Assignee: Yoshino Kogyosho Co., Ltd., Tokyo, Japan

[21] Appl. No.: 818,432

[22] Filed: Dec. 27, 1991

Related U.S. Application Data

[63] Continuation of Ser. No. 450,435, Dec. 14, 1989, abandoned.

[30] Foreign Application Priority Data

| | | | |
|---|---|---|---|
| Dec. 16, 1988 | [JP] | Japan | 63-163288[U] |
| Dec. 20, 1988 | [JP] | Japan | 63-165184[U] |
| Dec. 21, 1988 | [JP] | Japan | 63-165345[U] |
| Dec. 23, 1988 | [JP] | Japan | 63-166686[U] |

[51] Int. Cl.[5] ..... B43K 5/10; B43K 5/04

[52] U.S. Cl. ..... 401/151; 401/170; 401/176

[58] Field of Search ..... 401/171, 174, 176, 179, 401/151, 170, 180

[56] References Cited

U.S. PATENT DOCUMENTS

| | | | |
|---|---|---|---|
| 519,223 | 5/1894 | Bailey . | |
| 1,138,772 | 5/1915 | Matthews . | |
| 1,207,121 | 12/1916 | Ziedler . | |
| 1,348,681 | 8/1920 | Wright . | |
| 1,557,357 | 10/1925 | Gornell . | |
| 1,860,911 | 5/1932 | Trimble | 401/174 |
| 2,293,211 | 8/1942 | Mureau . | |
| 2,623,231 | 12/1952 | Gutenstein . | |
| 3,140,695 | 7/1964 | Fehling et al. . | |
| 3,167,806 | 2/1965 | Hogan . | |
| 3,181,539 | 5/1965 | Aston . | |
| 3,351,074 | 11/1967 | Aston . | |
| 3,359,992 | 12/1967 | Cishek et al. . | |
| 3,468,612 | 9/1969 | Aston . | |
| 4,033,700 | 7/1977 | Spatz . | |
| 4,309,119 | 1/1982 | Wittersheim . | |
| 4,405,249 | 9/1983 | Scales . | |
| 4,433,799 | 2/1984 | Corsette . | |
| 4,624,594 | 11/1986 | Sasaki | 401/180 |
| 4,655,690 | 4/1987 | Boedecker et al. . | |
| 4,776,717 | 10/1988 | Iizuka et al. . | |
| 4,808,022 | 2/1989 | Iizuka et al. . | |
| 4,852,772 | 8/1989 | Ennis, III . | |

FOREIGN PATENT DOCUMENTS

| | | |
|---|---|---|
| 165657 | 1/1954 | Australia . |
| 62059/65 | 2/1967 | Australia . |
| 51333 | 10/1973 | Australia . |
| 0123518 | 10/1984 | European Pat. Off. . |
| 199597 | 10/1986 | European Pat. Off. . |
| 2630569 | 1/1978 | Fed. Rep. of Germany . |
| 959036 | 3/1950 | France . |
| 2551636 | 3/1985 | France . |
| 552673 | 12/1956 | Italy . |
| 62-86111 | 6/1987 | Japan . |
| 63-52511 | 4/1988 | Japan . |
| 136990 | 8/1952 | Sweden . |
| 688891 | 3/1953 | United Kingdom . |
| 1562817 | 3/1980 | United Kingdom . |
| 2150424 | 7/1985 | United Kingdom . |

*Primary Examiner*—Danton D. DeMille
*Attorney, Agent, or Firm*—Oliff & Berridge

[57] ABSTRACT

A liquid container comprising: a holder sleeve; a cylinder for forming a pressurized chamber, said cylinder being axially movable; a cylinder cam for axially moving said cylinder by rotating said holder sleeve; and projections axially movable between said holder sleeve, said cylinder being engaged with said cylinder cam. The liquid contained in the container can be supplied to a liquid applicator means not only by pushing in a push button provided at the bottom of the container but also by rotating the holder sleeve.

10 Claims, 9 Drawing Sheets

COSMETIC APPLICATOR BRUSH HAVING A RESERVOIR AND INSULATED, PRESSURIZED CHAMBER

This is a continuation of application Ser. No. 07/450,435 filed Dec. 14, 1989, now abandoned.

BACKGROUND OF THE INVENTION

1. Field of the Invention

This invention relates to a liquid container and more particularly to a liquid container with an applicator means such as an applicator brush for containing a cosmetic liquid such as an eyebrow coloring agent or rouge.

2. Prior Art

There have been known liquid containers for cosmetics, each provided with an applicator brush in the form of a writing brush, wherein the cosmetic liquid contained in the container is supplied to a tip of the brush at a low rate by pushing a push button provided at a bottom of the container by a finger.

Referring to FIG. 1 of the accompanying drawings, which illustrates a preferred embodiment of the present invention but is also good for understanding a fundamental structure of a conventional container of the type as described above because of their similarity, such a conventional container has a cylinder 11 for forming a central pressurized chamber A comprising a lower cylindrical member 2 and an upper cylindrical member 3. A return spring 12 is arranged between said lower cylindrical member 2 and said upper cylindrical member 3. The upper cylindrical member 3 and the lower cylindrical member 2 are axially slidable relative to each other. A container body 1 for containing liquid is fitted to said lower cylindrical member 2. An applicator brush 4 and a holder sleeve 6 are fitted to said upper cylindrical member 3. A suction valve 9 is provided in the lower cylindrical member 2 and a discharge valve 5 is provided in the upper cylindrical member 3. When a push button 18 provided at a bottom of the container 1 is pushed in so that the container body 1 and the lower cylindrical member 2 are forcibly pushed into the upper cylindrical member 3, a pressure of the liquid contained in the pressurized chamber A increases and the pressurized liquid pushes up a valve body 15 of the discharge valve 5 against a resilient body 14. Then, the valve body 15 is separated from a valve seat 16 of the discharge valve 5 to open the discharge valve 5 so that the liquid in the pressurized chamber A is supplied to the applicator brush 4. When the liquid is supplied to the brush 4 so that the pressurized chamber A becomes under negative pressure, the suction valve 9 is opened to transfer a certain amount of liquid from the container body 1 into the pressurized chamber A. When the liquid is transferred from the container body 1 so that the container body 1 becomes under negative pressure, a bottom cover 8 provided in the container body 1 goes up to offset the negative pressure.

It has been desired that the liquid contained in a liquid container with an applicator brush as described above can be supplied to the brush tip not only by a pushing action but also by a revolving action of the user.

SUMMARY OF THE INVENTION

It is therefore a primary object of the present invention to provide a liquid container, wherein the liquid contained in the container can be supplied to a liquid applicator means of the container not only by pushing in a push button provided at the bottom of the container but also by rotating a holder sleeve of the container.

According to the invention, there is provided a liquid container comprising a holder sleeve; a cylinder for forming a pressurized chamber, said cylinder being axially movable; a cylinder cam for axially moving said cylinder by rotating said holder sleeve; and projections axially movable between said holder sleeve, said cylinder being engaged with said cylinder cam.

According to one aspect of the present invention, there is provided a liquid container comprising: a container body having a barrel member, an axially slidable bottom cover positioned inside said barrel; a lower cylindrical member of a cylinder for forming an axially movable pressurized chamber, said lower cylindrical member being provided with a suction valve at a lower end opening and a projection on an outer surface and fitted to said container body; an upper cylindrical member of the cylinder having an outer cylindrical wall and an inner cylindrical wall respectively in contact with the outer surface and an inner surface of said lower cylindrical member, said upper cylindrical member being axially movable relative to said lower cylindrical member against a return spring provided between said lower cylindrical member and said upper cylindrical member, said upper cylindrical member not being rotatable relative to said lower cylindrical member by an axial groove-ridge engagement; a liquid applicator means provided at an upper end opening of said upper cylindrical member; a discharge valve for closing an opening of said upper cylindrical member by pressing a valve body formed at a lower end of an axially deformable resilient body against a valve seat formed on an inner surface of said upper cylindrical member; and a holder sleeve rotatably fitted to an outer periphery of the outer cylindrical wall of said upper cylindrical member, said holder sleeve having an inward flange on an inner surface thereof, said inward flange having a projection and a recess in an axial direction and being engaged with said projection on said lower cylindrical member.

According to another aspect of the present invention, there is provided a liquid container comprising: a container body having a barrel member, an axially slidable bottom cover positioned inside said barrel; a lower cylindrical member of a cylinder for forming an axially movable pressurized chamber, said lower cylindrical member being provided with a suction valve at a lower end opening and a projection on an outer surface and a downward-facing step having teeth at a middle of the outer surface thereof, said lower cylindrical member being fitted to said container body; an upper cylindrical member of the cylinder having an outer cylindrical wall and an inner cylindrical wall respectively in contact with the outer surface and an inner surface of said lower cylindrical member, said upper cylindrical member being axially movable relative to said lower cylindrical member against a return spring provided between said lower cylindrical member and said upper cylindrical member, said upper cylindrical member having a longitudinal groove engaged with said projection; a liquid applicator means provided at an upper end opening of said upper cylindrical member; a discharge valve for closing an opening of said upper cylindrical member by pressing a valve body formed at a lower end of an axially deformable resilient body against a valve seat formed on an inner surface of said upper cylindrical member; and a holder sleeve rotatably fitted to an outer periphery of the outer cylindrical wall of said upper cylindrical member, said holder sleeve having teeth on an inner surface thereof, said teeth being engaged with said teeth of the lower cylindrical member.

According to further another aspect of the present invention, there is provided a liquid container comprising; a container body having a barrel member, an axially slidable bottom cover positioned inside said barrel; a lower cylindrical member of a cylinder for forming an axially movable pressurized chamber, said lower cylindrical member being provided with a suction valve at a lower end opening and a projection on an outer surface and fitted to said container body, said lower cylindrical member being provided with a downward-facing step having an undulated and radially curved surface at a middle of the outer surface thereof; an upper cylindrical member of the cylinder having an outer cylindrical wall and an inner cylindrical wall respectively in contact with the outer surface and an inner surface of said lower cylindrical member, said upper cylindrical member being axially movable relative to said lower cylindrical member against a return spring provided between said lower and cylindrical member and said upper cylindrical member, said upper cylindrical member having a longitudinal groove engaged with said projection; a liquid applicator means provided at an upper end opening of said upper cylindrical member; a discharge valve for closing an opening of said upper cylindrical member by pressing a valve body formed at a lower end of an axially deformable resilient body against a valve seat formed on an inner surface of said upper cylindrical member; and a holder sleeve rotatably fitted to an outer periphery of the outer cylindrical wall of said upper cylindrical member, said holder sleeve having a projection engaged with said undulated surface.

According to further another aspect of the present invention, there is provided a liquid container comprising: a container body having a barrel member, an axially slidable bottom cover positioned inside said barrel; a lower cylindrical member of a cylinder for forming an axially movable pressurized chamber, said lower cylindrical member being provided with a suction valve at a lower end opening and a projection on an outer surface and fitted to said container body, said lower cylindrical member being provided with a downward-facing step having a projection; an upper cylindrical member of the cylinder having an outer cylindrical wall and an inner cylindrical wall respectively in contact with the outer surface and an inner surface of said lower cylindrical member, said upper cylindrical member being axially movable relative to said lower cylindrical member against a return spring provided between said lower cylindrical member and said upper cylindrical member, said upper cylindrical member having a longitudinal groove engaged with said projection; a liquid applicator means provided at an upper end opening of said upper cylindrical member; a discharge valve for closing an opening of said upper cylindrical member by pressing a valve body formed at a lower end of an axially deformable resilient body against a valve seat formed on an inner surface of said upper cylindrical member; and a holder sleeve rotatably fitted to an outer periphery of the outer cylindrical wall of said upper cylindrical member, said holder sleeve having an undulated surface engaged with said projection.

According to further another aspect of the present invention, there is provided a liquid container comprising: a container body having a barrel member, an axially slidable bottom cover position inside said barrel; a lower cylindrical member of a cylinder for forming an axially movable pressurized chamber, said lower cylindrical member being provided with a suction valve at a lower end opening and a projection on an outer surface and fitted to said container body; an upper cylindrical member of the cylinder having an outer cylindrical wall and an inner cylindrical wall respectively in contact with the outer surface and an inner surface of said lower cylindrical member, said upper cylindrical member being axially movable relative to said lower cylindrical member against a return spring provided between said lower cylindrical member and said upper cylindrical member, said upper cylindrical member not being rotatable relative to said lower cylindrical member, said outer cylindrical wall having an engagement window, said engagement window having a radially inclined lower edge, said lower edge being engaged with said projection; a liquid applicator means provided at an upper end opening of said upper cylindrical member; a discharge valve for closing an opening of said upper cylindrical member by pressing a valve body formed at a lower end of an axially deformable resilient body against a valve seat formed on an inner surface of said upper cylindrical member; and a holder sleeve rotatably fitted to an outer periphery of the outer cylindrical wall of said upper cylindrical member, said holder sleeve being axially slidable but not rotatable with said lower cylindrical member by a longitudinal engagement.

Now the present invention will be described in more detail by referring to the accompanying drawings that illustrate preferred embodiments of the invention.

BRIEF DESCRIPTION OF THE INVENTION

FIG. 1 is a vertical sectional view of a first embodiment of the present invention;

FIG. 2*a* is a vertical sectional view of a portion of a holder sleeve of the embodiment of FIG. 1;

FIG. 2*b* is a front view of a lower cylindrical member of a cylinder of the embodiment of FIG. 1:

FIG. 2*c* is a horizontal sectional view of the embodiment of FIG. 1 cut along C—C line.

Figure 4:
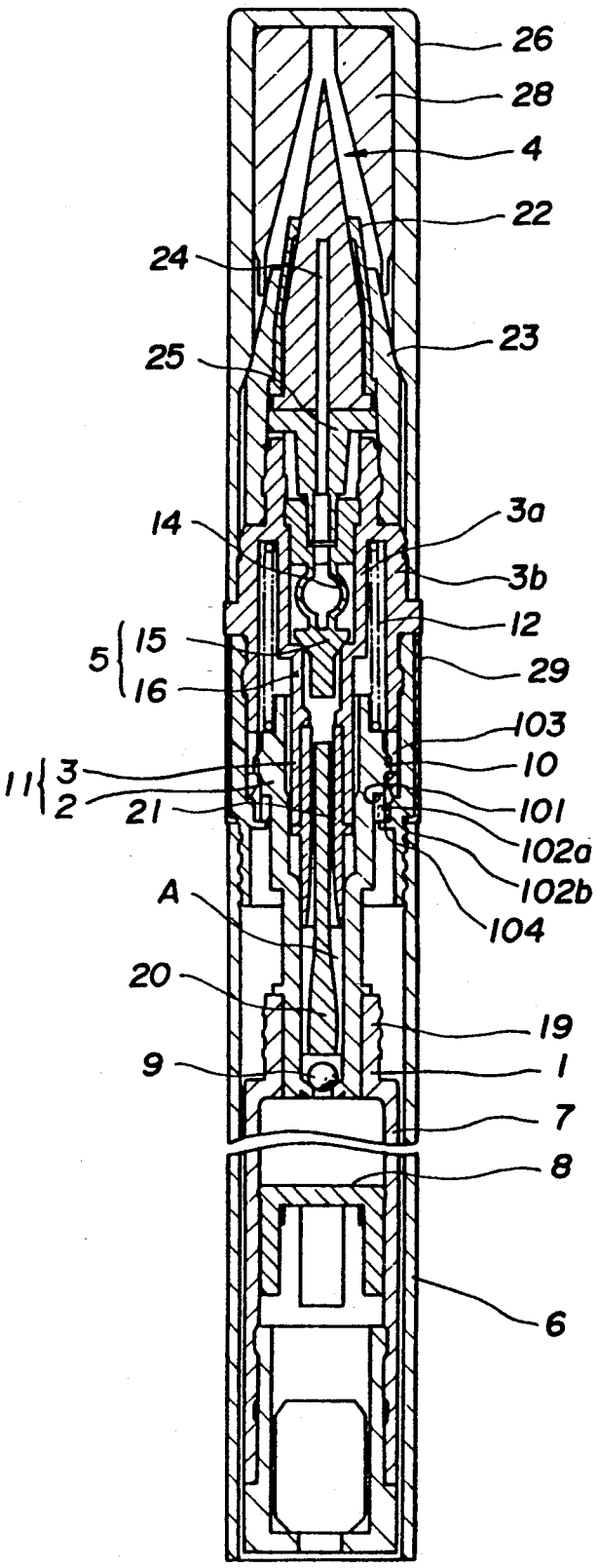
FIG. 4 is a vertical sectional view of a third embodiment of the present invention.
Figure 6:
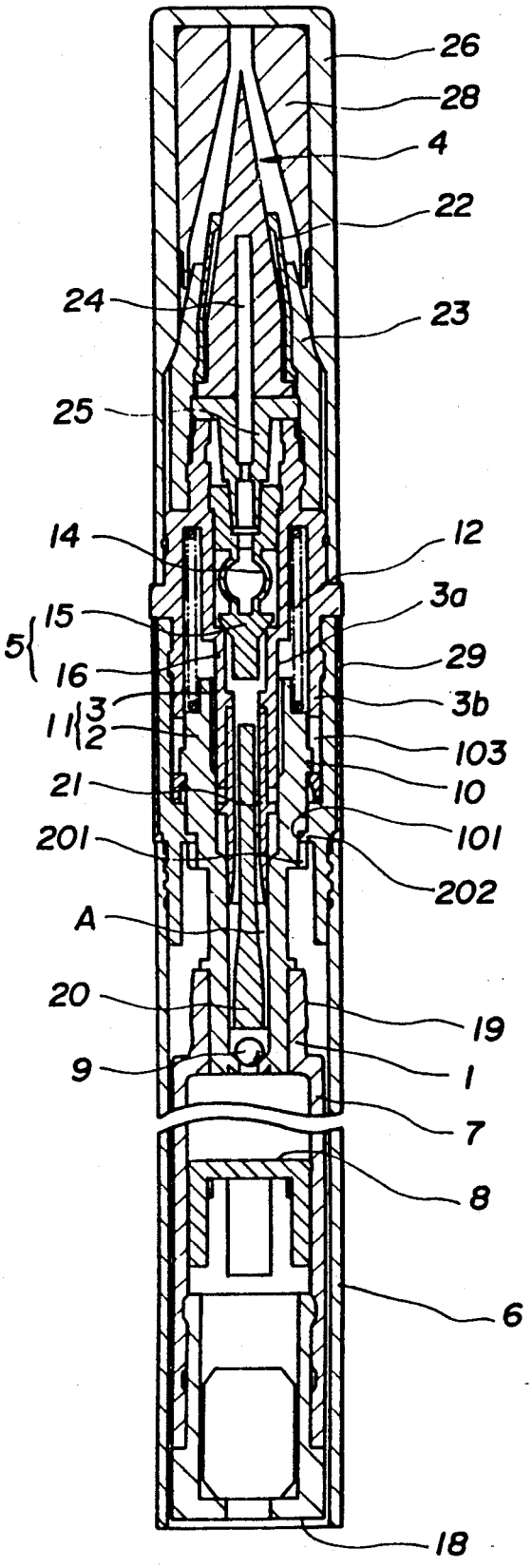
Figure 7A:
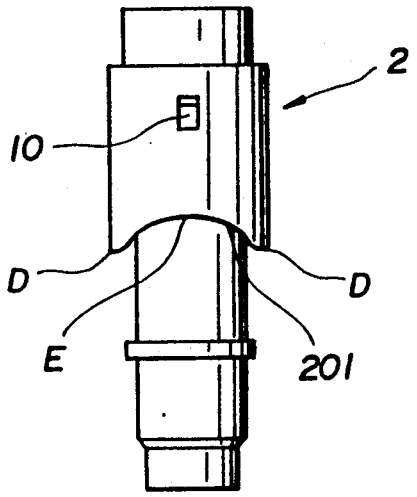
Figure 7B:
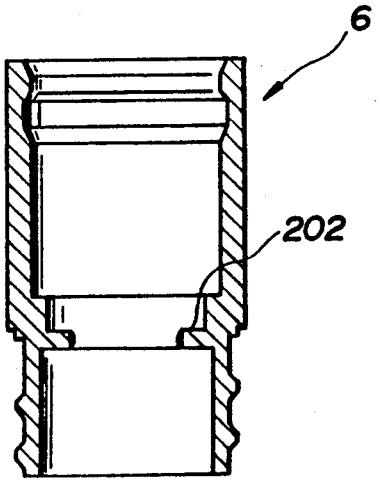
Figure 8:
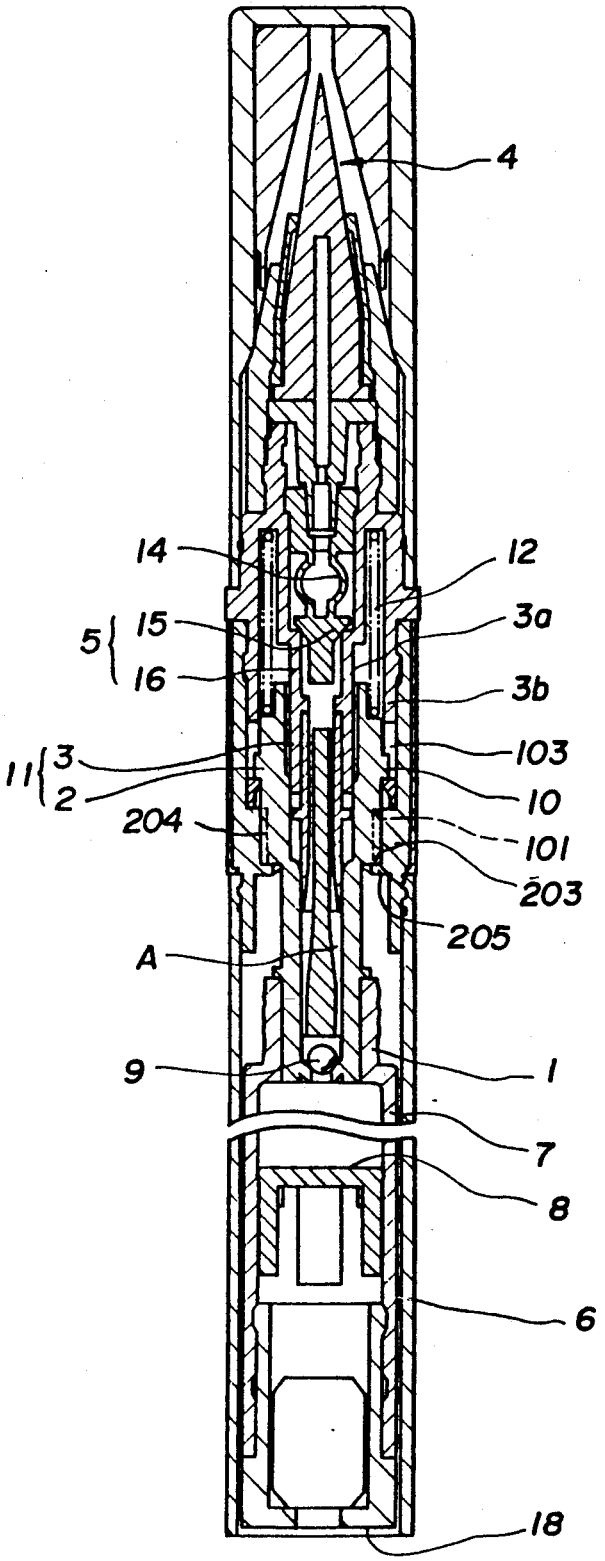
Figure 9A:
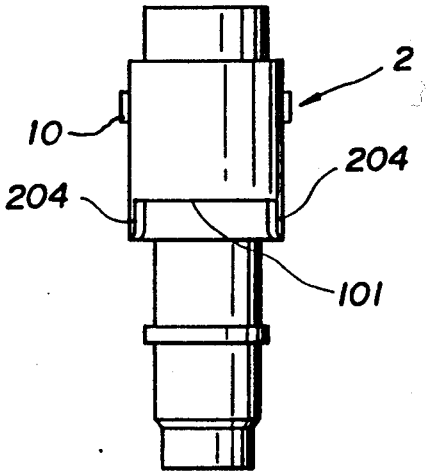
Figure 9B:
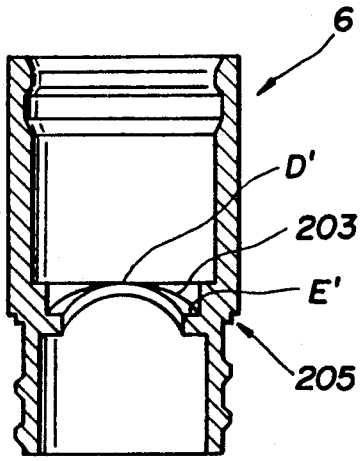
Figure 10:
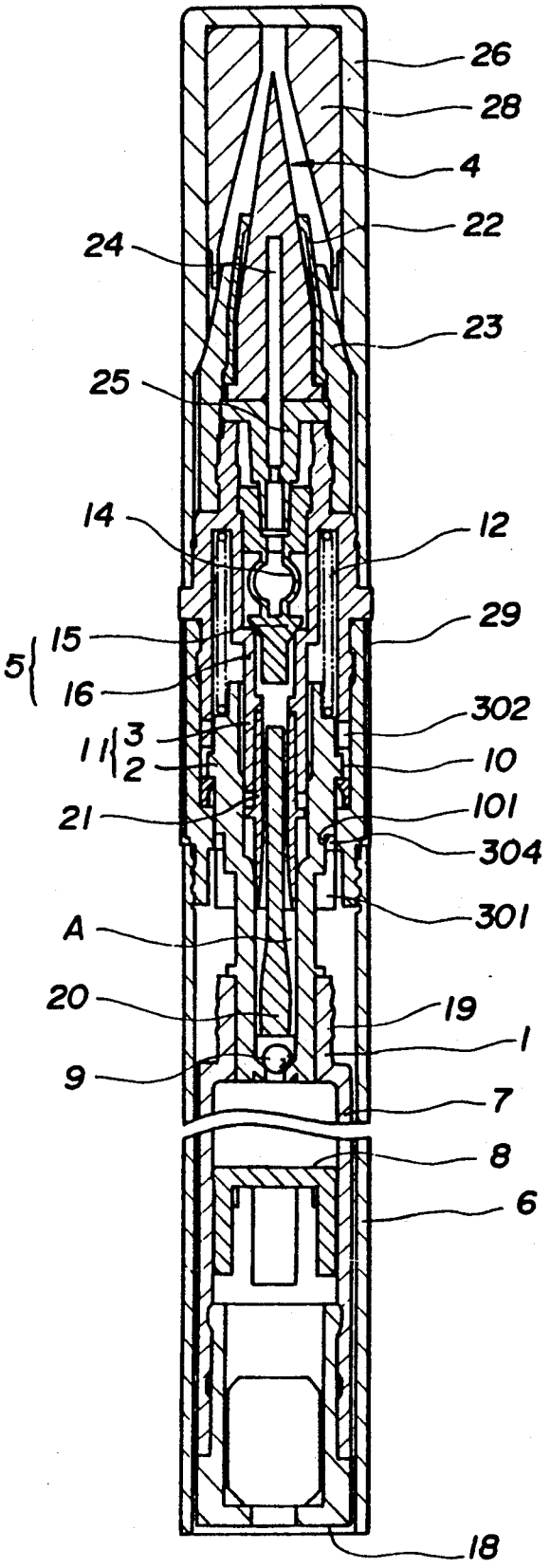
Figure 11:
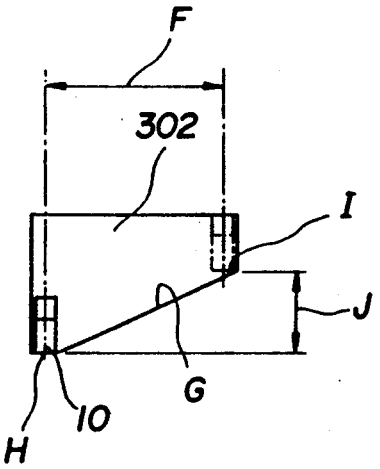
Figure 12A:
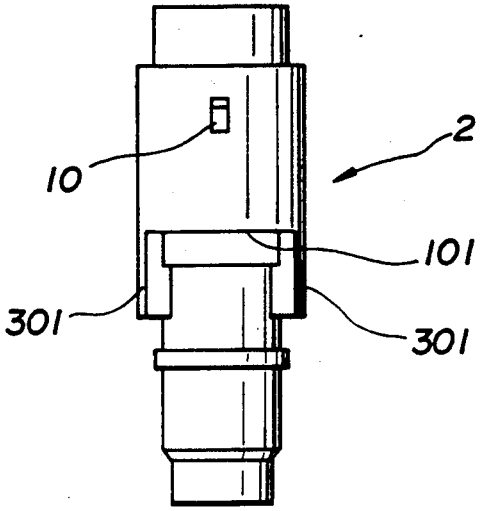
Figure 12B:
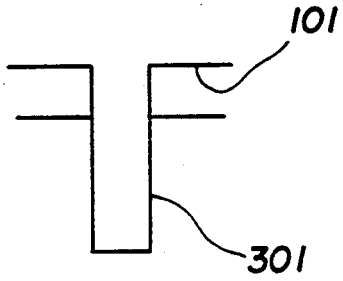
Figure 13A:
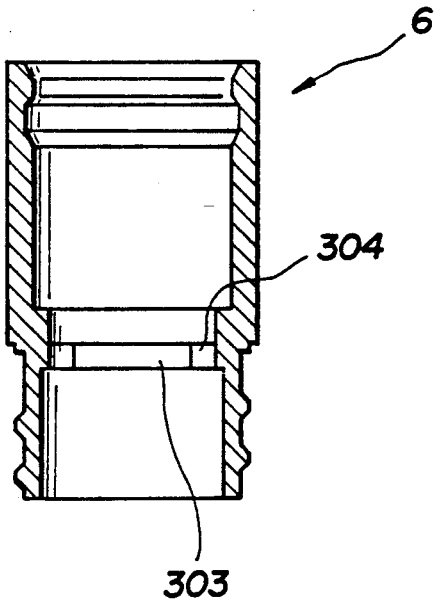
Figure 13B:
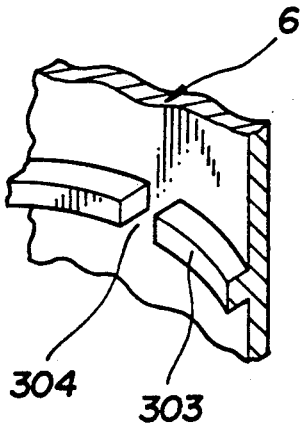
Figure 14:
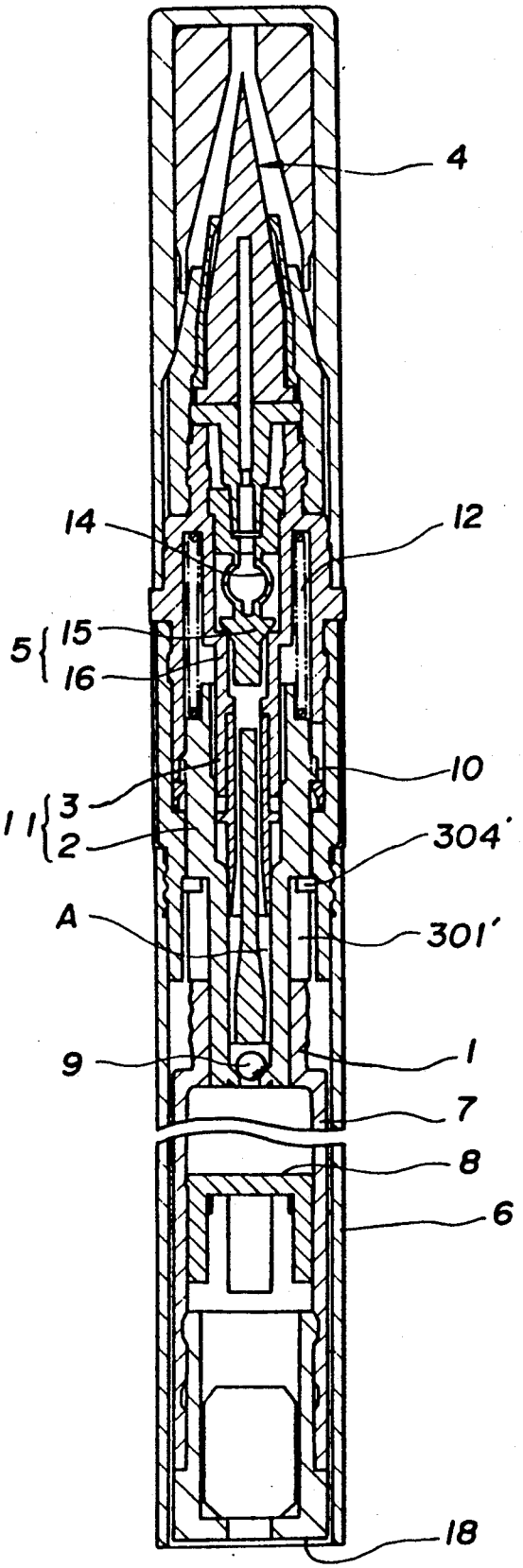
Figure 15:
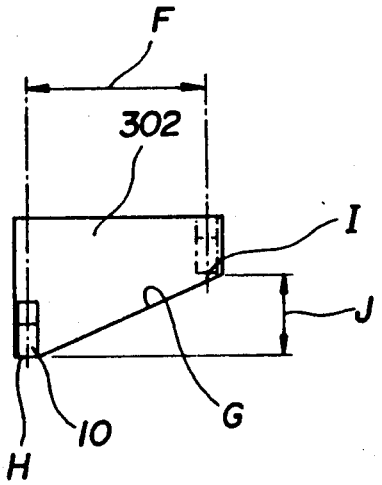
Figure 16:
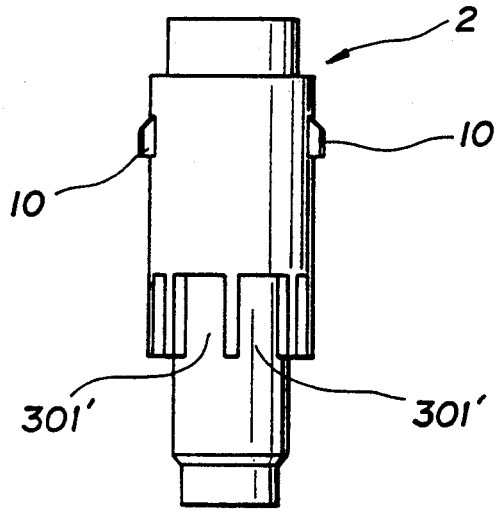
Figure 17:
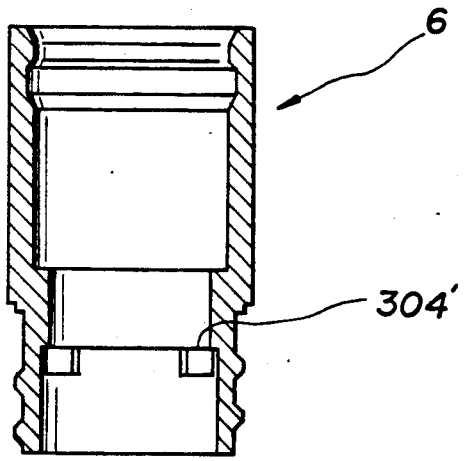
Figure 17:
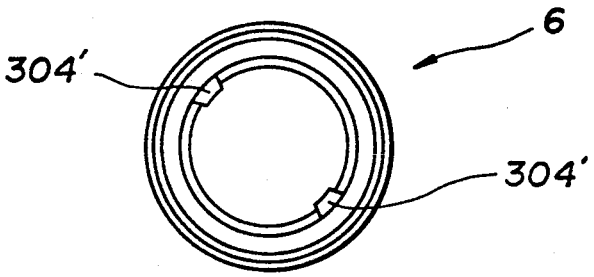

FIG. 5*a* is a partial view of a portion of the ratchet type push-up mechanism cf the embodiment of FIG. 4 in a normal condition:

FIG. 5*b* is a view corresponding to FIG. 5*a* showing when the ratchet type push-up mechanism is in operation:

FIG. 6 is a vertical sectional view of a fourth embodiment of the present invention:

FIG. 7*a* is a front view of the lower cylindrical member of the cylinder of the embodiment of FIG. 6:

FIG. 7*b* is a vertical sectional view of a portion of the holder sleeve of the embodiment of FIG. 6:

FIG. 8 is a vertical sectional view of a fifth embodiment of the present invention:

FIG. 9*a* is a front view of the lower cylindrical member of the cylinder of the embodiment of FIG. 8:

FIG. 9*b* is a vertical sectional view of a portion of the holder sleeve of the embodiment of FIG. 8:

FIG. 10 is a vertical sectional view of a sixth embodiment of the present invention:

FIG. 11 is an illustration showing an engagement window of the upper cylindrical member of the cylinder of the embodiment of FIG. 10:

FIG. 12*a* is a front view of the lower cylindrical member of the embodiment of FIG. 10:

FIG. 12*b* is a lateral view of a portion of the lower cylindrical member of the embodiment of FIG. 10:

FIG. 13*a* is a vertical sectional view of a portion of the holder sleeve of the embodiment of FIG. 10:

FIG. 13*b* is a perspective view showing an inside of a portion of the holder sleeve of the embodiment of FIG. 10:

FIG. 14 is a vertical sectional view of a seventh embodiment of the present invention:

FIG. 15 is a front view of the lower cylindrical member of the embodiment of FIG. 10:

FIG. 16 is a front view showing a portion of the holder sleeve of the embodiment of FIG. 10:

FIG. 17*a* is a vertical sectional view showing a portion of the holder sleeve of the embodiment of FIG. 10: and FIG. 17*b* is a perspective view showing the inside of a portion of the holder sleeve of the embodiment of FIG. 10.

DETAILED DESCRIPTION OF THE PREFERRED EMBODIMENTS

Referring to FIGS. 1, 2*a*, 2*b* and 2*c* which illustrate a first preferred embodiment of the liquid container according to the invention, a container body 1 has a straight and cylindrical barrel member 7 and a neck member 19 standing up from an upper (nearer to the applicator brush) end of the barrel member. A push button 18 is engagedly fitted into a lower opening of said container body 1. An axially slidable bottom cover 8 is air-tightly arranged along an inner peripheral wall of the barrel member 7.

A cylinder 11 for forming a pressurized chamber (A) comprises a lower cylindrical member 2 and an upper cylindrical member 3.

A lower end portion of said lower cylindrical member 2 is engaged with said neck member 19 of the container body 1 and rigidly fitted thereto. Thus, when the lower cylindrical member 2 is moved along an axial line of the liquid container, the container body 1 is also moved together with the lower cylindrical member 2. A suction valve 9 is fitted to a lower end opening of said lower cylindrical member 2. In this embodiment, the suction valve 9 is realized in the form of a ball valve. A regulator rod 20 is arranged along an axis of the lower cylindrical member 2. A pair of projections 10, 10 are diametrically arranged near an upper end of an outer periphery of the lower cylindrical member 2. It should be noted that the number as well as the arrangement of the projections are not limited to those of this embodiment.

Figure 1:
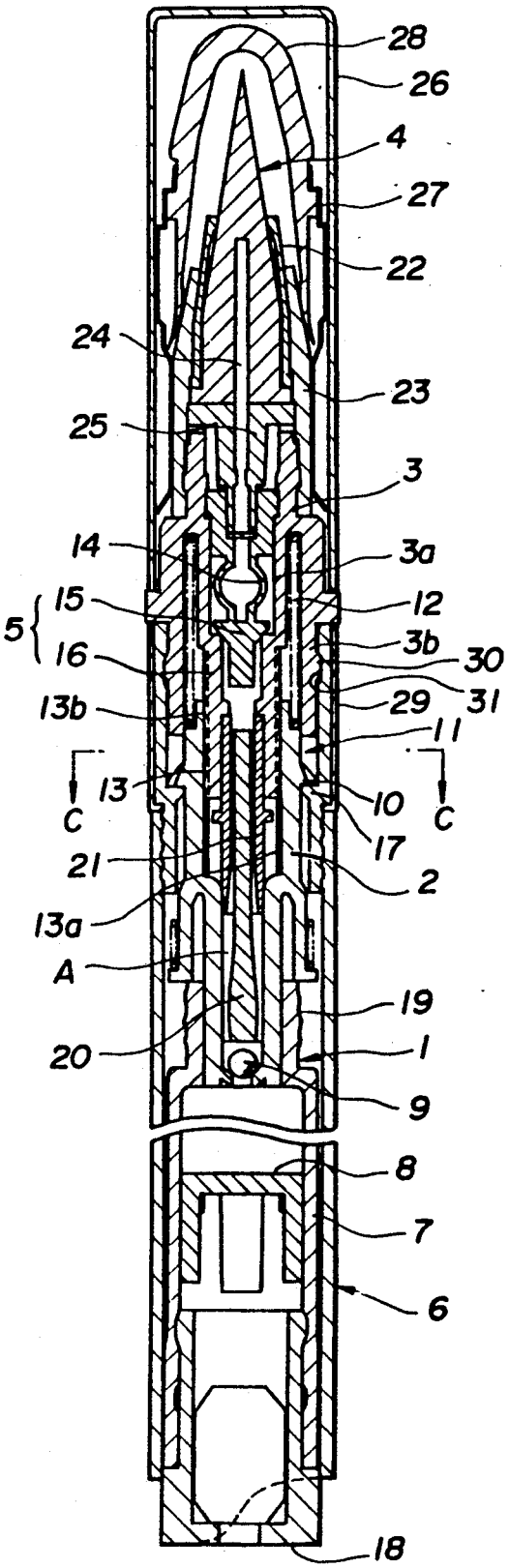
Figure 2A:
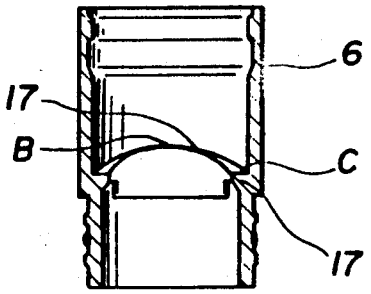
Figure 2B:
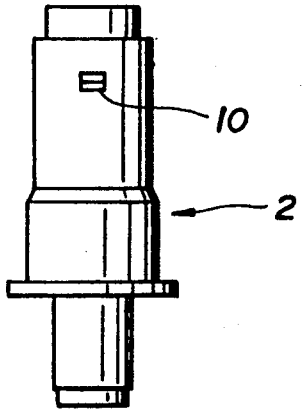
Figure 2C:
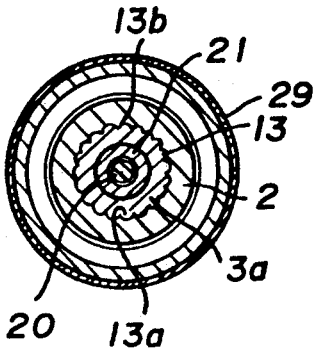

In a liquid container of the first embodiment, one or more longitudinal ridges 13*a* are formed on an upper portion of the inner peripheral wall of the lower cylindrical member 2 and a plurality of parallel and longitudinal ridges 13*a* are formed in the embodiment illustrated in FIG. 1.

The upper cylindrical member 3 of the cylinder 11 has an inner cylindrical wall 3*a* and an outer cylindrical wall 3*b*. The inner cylindrical wall 3*a*, is slidably arranged on an inner periphery of the upper portion of said lower cylindrical member 2. The outer cylindrical wall 3*b* is slidably arranged on an outer periphery of the upper portion of said lower cylindrical member 2. A lower half of said inner cylindrical wall 3*a* has a reduced diameter to form a step between an upper half and a lower half of the inner cylindrical wall 3*a*, an inner portion of said step serving as a valve seat 16 for a discharge valve 5. A stopper pipe 21 is rigidly fitted to an inside of a lower end portion of said upper cylindrical member 3. A lower end portion of said stopper pipe 21 is resilient, widened and so arranged that it is tightly pressed against the inner peripheral wall of the lower cylindrical member 2. A horizontal ridge 30 is formed on an outer surface of the outer cylindrical wall 3*b* of said upper cylindrical member 3.

In a liquid container according to the first embodiment, one or more longitudinal grooves 13*b* are formed on the lower portion of the outer periphery of the inner cylindrical wall 3*a* that faces the inner surface of the lower cylindrical member 2. In the embodiment illustrated in FIG. 1, a plurality of parallel and longitudinal grooves 13*b* are formed corresponding to the longitudinal ridges 13*a* formed on the inner surface of said lower cylindrical member 2. Each of said longitudinal grooves 13*b* is engaged with a corresponding one of the longitudinal ridges 13*a* to form longitudinal groove-ridge engagements 13. Due to these longitudinal groove-ridge engagements, the upper cylindrical member 3 and the lower cylindrical member 2 are axially slidable relative to each other but are not horizontally rotatable relative to each other.

A liquid applicator means is provided at a top of the upper cylindrical member 3. In the illustrated embodiment, the liquid applicator means is a cosmetic applicator brush 4. Said cosmetic applicator brush 4 is extended upwardly from the upper end of said upper cylindrical member 3. An outside of a lower half portion of said cosmetic applicator brush 4 is tightly held by a holder sleeve 22. The cosmetic applicator brush 4 with the holder sleeve 22 is further tightly and rigidly held by an anchor sleeve 23 provided on the upper end portion of the outer surface of the upper cylindrical member 3. An axial tube 24 forms an axial core of the cosmetic applicator brush 4. Due to the axial tube 24, the brush 4 communicates with the upper cylindrical member 3 through a connector pipe 25 located at a lower end of the cosmetic applicator brush 4.

A valve body 15 of the discharge valve 5 has a shape of an inverted frustum of circular cone and is located at a lower end of a resilient member 14. Said resilient member 14 is ring-shaped, made of elastic material and rigidly fitted to the inside of the upper portion of said upper cylindrical member 3. Moreover, said resilient member 14 is deformable in an axial direction. The valve body 15 is pressed downwardly against a valve seat 16 by said resilient member 14 to air-tightly close the discharge valve 5 under normal conditions.

A holder sleeve 6 has a shape of a straight and hollow cylinder. In the illustrated embodiment, the holder sleeve 6 comprises an upper member and a lower member. The upper member is screwed into the lower member to form an integral component. A horizontal groove 31 is formed on an inner surface of said holder sleeve 6 near an upper end thereof. Said horizontal groove 31 is engaged with the horizontal ridge 30 provided on the outer surface of the outer cylindrical wall 3*b* so that the holder sleeve 6 and the upper cylindrical member 3 are rotatable relative to each other but are not axially slidable relative to each other. There is a space provided between an inside of said holder sleeve 6 and the outer surface of the barrel member 7 of the container body 1. A portion of a lower edge of the holder sleeve 6 may be cut out so that the push button 18 can be pushed in with ease.

In the first embodiment, an inward flange 17 is provided on the inner surface of the holder sleeve 6 near the upper end thereof to form a cam surface. An upper surface of said inward flange 17 abuts said pair of projections 10, 10. Said inward flange 17 has a projection B and a recesses C. In other words, the stretch between the recesses C, C is gently raised upwardly to form a wavy contour of the upper surface of the flange 17. The distance between a top of the projection B and the bottom of the recess C is identical with a stroke of the push button 18 when it is pushed up. In the embodiment illustrated in FIG. 1, a pair of projections are radially arranged.

A return spring 12 is arranged between a step formed at the top of the lower cylindrical member 2 and a groove formed between the inner cylindrical wall 3*a* and the outer cylindrical wall 3*b* of the upper cylindrical member 3. The return spring 12 urges the lower cylindrical member 2 and the upper cylindrical member 3 away from each other.

Reference numeral 26 denotes a cap. Said cap 26 is provided with an inner cap 28 which is attached to the cap 26 by means of a fitting member 27 to prevent the cosmetic applicator brush 4 from desiccation. The holder sleeve 6 is provided at its upper outside area with an outer sleeve 29.

The cap 26, the fitting member 27 and the outer sleeve 29 are made of metal although they may be made of synthetic resin, whereas all the other components are made of a synthetic resin material.

In the first embodiment of the present invention, the lower cylindrical member 2 and the container body 1 are normally pushed downwardly by the return spring 12 and their downward movement is blocked by the projections 10, 10 which abut the recesses C, C of the inward flange 17, respectively. When the push button 18 is pushed so that the container body 1 and the lower cylindrical member 2 are pushed in against the urge of the return spring 12, a pressure of the liquid contained in the pressurized chamber (A) increases. Then the liquid subjected to a higher pressure pushes up the valve body 15 against the resilient body 14 to separate the valve body 15 from the valve seat 16. Consequently, the discharge valve 5 is opened and the liquid in the pressurized chamber (A) is moved to the liquid applicator means (cosmetic applicator brush 4). When the pressing of the push button 18 is stopped so that the liquid pressure in the pressurized chamber (A) becomes lower than the resilient force of the resilient member 14, the discharge valve 5 is closed, and the container body 1 and the lower cylindrical member 2 are returned by the return spring 12. Therefore, the interior of the pressurized chamber (A) is evacuated to become of negative relative pressure to open the suction valve 9, and liquid in the container body 1 is sucked into the pressurized chamber (A). When the liquid is thus reduced in the container body 1 so that the interior of the container body 1 becomes of negative relative pressure, the slidable bottom cover 8 rises upwardly in the container body 1 to eliminate the negative pressure therein.

When the holder sleeve 6 is rotated relative to the upper cylindrical member 3 of the cylinder 11, the projections 10, 10 are moved along the undulated surface of the inward flange 17 so that the holder sleeve 6 is pushed upwardly by the projections B, B on the undulated surface of the inward flange 17 to push up the lower cylindrical member 2 of the cylinder 11 and the container body 1. Consequently, the pressure of the liquid contained in the pressurized chamber (A) increases and, thus the liquid in the pressurized chamber (A) is fed to the liquid applicator means. In the embodiment illustrated in FIG. 1, When the holder sleeve 6 is rotated by 90° relative to the upper cylindrical member 3, the projections 10, 10 are pushed up by the projections on the undulated surface of the inward flange 17 and the liquid is moved to the liquid applicator means 4. If the holder sleeve 6 is rotated further by 90° relative to the upper cylindrical member 3, the projections 10, 10 move to the recesses C, C on the undulated surface of the inward flange 7 by the return spring 12.

Figure 3:
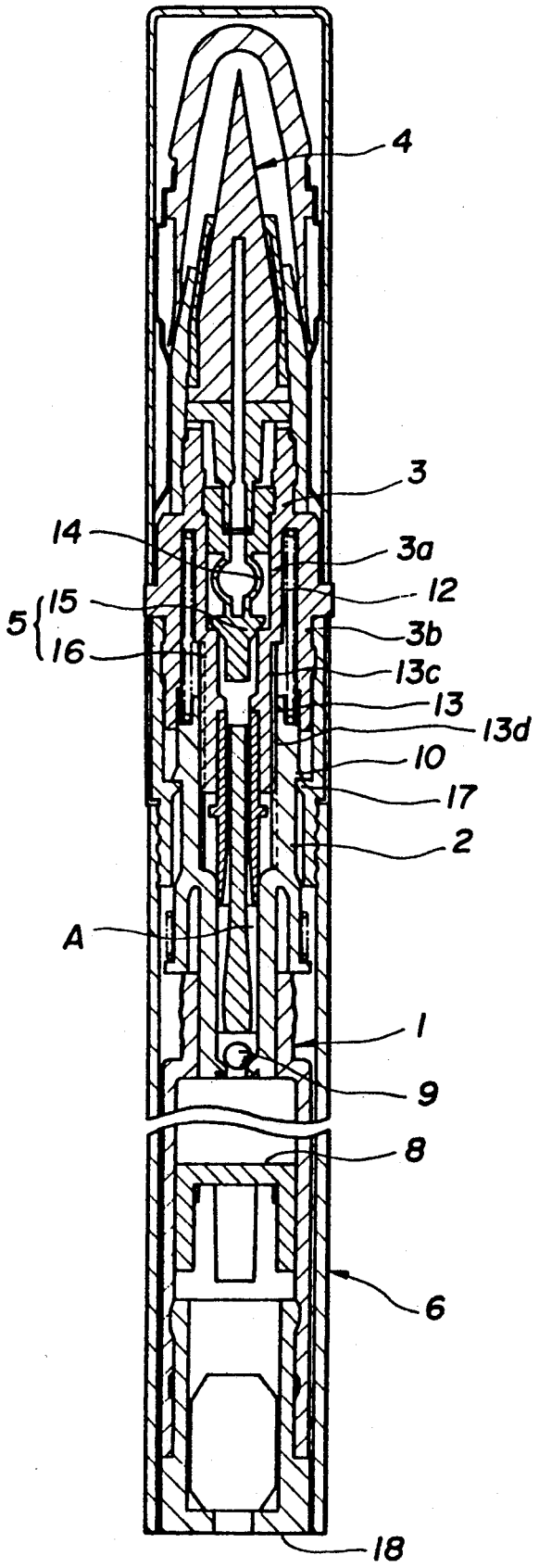
FIG. 3 is a vertical sectional view of a second embodiment of the present invention.

A second embodiment of the present invention as illustrated in FIG. 3 has a groove-ridge engagement 13 which is different from that of the first embodiment. As seen from FIG. 3, one or more longitudinal grooves 13*d* are formed on the inner surface of the lower cylindrical member 2 of the cylinder 11 and an equal number of longitudinal ridges 13*c* are formed on the outer cylindrical wall surface of the inner 3*a* of the upper cylindrical member 3 so that the upper cylindrical member 3 and the lower cylindrical member 2 are engagedly connected with each other by engagement of the longitudinal grooves 13*d* and the longitudinal ridges 13*c*.

As illustrated in FIG. 1, the lower end of the holder sleeve 6 of the first embodiment has a notched portion formed in a half of the lower end. However, the lower end of the holder sleeve 6 may be alternatively uniformly extended down to the lower surface of the push button 18 so that they may be arranged in a neat alignment.

Operation and other construction of the second embodiment are same as those of the first embodiment.

FIGS. 4, 5*a* and 5*b* illustrate a third embodiment of the invention.

Figure 5:
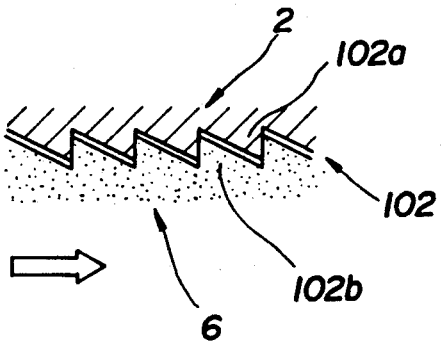
Figure 5:
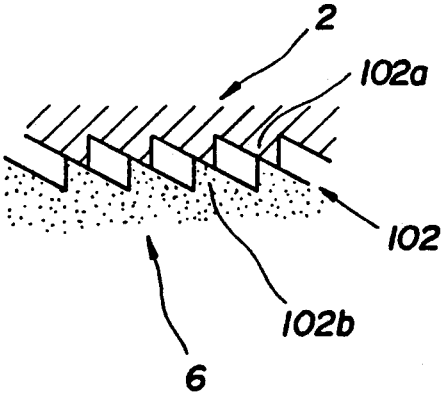

In the third embodiment, a lower half of the lower cylindrical member 2 has a reduced diameter to form a downward-facing step 101 at the middle of the outer surface of the lower cylindrical member 2. A series of teeth 102*a* of a ratchet-type push-up mechanism 102 are formed on said downward-facing step 101 as illustrated in FIG. 5(*a*).

A longitudinal groove 103 is formed on an upper area of the inner surface of the upper cylindrical member 3 of this third embodiment. This longitudinal groove 103 is engaged with the projection 10 formed on the lower cylindrical member 2 so that the lower cylindrical member 2 and the upper cylindrical member 3 cannot be rotated but are vertically slidable relative to each other. In the embodiment illustrated in FIG. 4, a pair of longitudinal grooves 103, 103 and a pair of the projections 10, 10 are formed.

An inward flange 104 is formed on the upper portion of the inner peripheral wall of the holder sleeve 6 of the third embodiment. On an upper surface of said inward flange 104, there are formed another series of teeth 102*b* of the ratchet-type push-up mechanism 102 to form a cylinder cam. A distance between a top of a tooth and a bottom of the following indentation is identical with the stroke of an action of the push button 18.

The construction of the third embodiment except the above described features is same as that described in the first embodiment.

In the third embodiment, liquid is fed to the liquid applicator means (cosmetic applicator brush 4) by pushing the push button 18 in a manner similar to that of the first embodiment. When the holder sleeve 6 is rotated relative to the upper cylindrical member 3, the teeth 102*b* of the ratchet-type push-up mechanism 102 are moved in a direction indicated by an arrow in FIG. 5(*a*) to take a position as shown in FIG. 5(*b*). Consequently, the lower cylindrical member 2 is pushed up relative to the upper cylindrical member 3 by the teeth 102*a*, because the lower cylindrical member 2 is vertically slidable to the upper cylindrical member 3 as described above. As a result, a pressure of the liquid contained in the pressurized chamber (A) increases and then the liquid in the pressurized chamber (A) is transferred to the liquid applicator means. The teeth 102*a* of the lower cylindrical member 2 is pushed down by the return spring 12.

FIGS. 6, 7*a* and 7*b* of the accompanying drawings illustrate a fourth embodiment of the invention.

In this fourth embodiment, the diameter of the lower half of the lower cylindrical member 2 is reduced to form the downward-facing step 101 at the middle of the outer surface of the lower cylindrical member 2. A downward-facing surface 201 of said downward-facing step 101 is a gently undulated surface having a projection D and a recess E along the axial line of the liquid container. In the embodiment illustrated in FIG. 7(*a*), a pair of projections D, D and a pair of recesses E, E are formed.

On the upper portion of the inner peripheral wall of the holder sleeve 6 of the fourth embodiment, there is provided a projection 202 which is engaged with the undulated surface 201 of said downward-facing step 101. Although two diametrically arranged projections are provided in the embodiment illustrated in FIG. 6, the number of projections is not necessarily limited to two and they may be arranged in a different manner.

Except the features as described above, the construction of the fourth embodiment is same as that described in the first embodiment.

Normally, the lower cylindrical member 2 is pushed downwardly by return spring 12 and the projections 202 are positioned on the recesses E of the undulated surface 201 or the lowest position to allow the embodiment to take a stabilized posture. When the push button 18 is pushed up, the liquid contained in the pressurized chamber (A) is transferred to the liquid applicator means (cosmetic applicator brush 4) in the same manner as the first embodiment. Now, if the holder sleeve 6 is rotated relative to the upper cylindrical member 3, the projections 202 move along the undulated surface 201 and consequently they are shifted from the recesses E to the projections D to push up the lower cylindrical member 2 and the container body 1 against the urge of the return spring 12. Then the pressure of the liquid in the pressurized chamber (A) increases and the liquid is supplied to the liquid applicator means. In the embodiment illustrated in FIG. 6, if the holder sleeve 6 of this embodiment is turned by 90° relative to the upper cylindrical member 3, the projections 202 are moved from the recesses E to the bulges D to push up the lower cylindrical member 2. If the holder sleeve 6 is turned further by another 90° relative to the upper cylindrical member 3, the projections 202 are moved down to the recesses E by the return spring 12.

FIGS. 8, 9*a* and 9*b* illustrate a fifth embodiment of the invention.

The fifth embodiment is realized by modifying the undulated surface 201 of the lower cylindrical member 2 and the projections 202 of the holder sleeve 6 of the fourth embodiment. In other words, the fifth embodiment has an undulated surface 203 formed on the holder sleeve 6 to form a cylinder cam and a projection 204 which is engaged with the undulated surface 203 and formed on the holder sleeve 6. The construction of the fifth embodiment is the same as that of the fourth embodiment in all other respects. More specifically, a horizontal ridge 205 is formed on the inner peripheral surface of the holder sleeve 6 and an undulated surface 203 provided with a projection D' and a recess E' is formed on an upper surface of the ridge 205. A projection 204 engaged with the undulated surface 203 is formed on the downward-facing step 101 of the lower cylindrical member 2. In the embodiment illustrated in FIG. 8, two projections 204 are formed.

FIGS. 10 through 13 illustrate a sixth embodiment of the present invention.

In this sixth embodiment, the diameter of the lower half of the lower cylindrical member 2 is reduced to form the downward-facing step 101 at the middle of the outer surface of the lower cylindrical member 2. An engaging member 301 is downwardly extended from said downward-facing step 101. In the embodiment illustrated in FIG. 2, there are provided two engaging members 301, 301.

Engagement windows 302 are formed on the lower portion of the outer cylindrical wall 3*b* of the upper cylindrical member 3 of the sixth embodiment to form a cylinder cam. The engagement windows 302 are realized by forming a notch on the outer cylindrical wall 3*b* in such a manner that it presents an angle of rotation F, preferably 120°. A lower edge of the engagement windows 302 is engaged with the projection 10. The lower edge of the engagement windows 302 is radially inclined and comprises a recess H and a projection I. The stroke J of an action of the lower edge of the engagement windows 302 is equal to the stroke of action of the push button 18 when it is pushed in. The height at the recess H of the engagement windows 302 is so determined not to block any relative movement of the upper cylindrical member 3 and the lower cylindrical member 2 when the push button is pushed in. A flange 303 is projected from the inner peripheral surface of the upper portion of the holder sleeve 6. A groove 304 is formed on said flange 303 so that said projections 301 of the lower cylindrical member 2 are engaged with the corresponding groove 304. Consequently, the holder sleeve 6 and the lower cylindrical member 2 are not rotatable relative to each other but are axially slidable relative to each other.

Preferably, a surface of the lower end of each of the projections 10 of the sixth embodiment are spherical so that the projection 10 automatically comes back to the recess H of the engagement window 302 by the return spring 12 after the rotational movement of the upper cylindrical member 3 and the lower cylindrical member 2 is stopped.

Except for the features as described above, the configuration of the sixth embodiment is the same as that described for the first embodiment. Normally, the projections 10 of the lower cylindrical member 2 are positioned on the corresponding recesses H of the engagement windows 302 of the upper cylindrical member 3. When the push button 18 is pushed up, the liquid contained in the pressurized chamber (A) is supplied to the liquid applicator means (cosmetic applicator brush 4) in a manner the same as that of the first embodiment. When the holder sleeve 6 is rotated relative to the upper cylindrical member 3, the lower cylindrical member 2 is also rotated with the holder sleeve 6 because of the engagement of the grooves 304 of the holder sleeve 6 and the projections 301 of the lower cylindrical member 2. Consequently, the projections 10 are respectively moved from the recesses H to the projections I along the lower edge G of the engagement window 302 to push up the projections 10 of the lower cylindrical member 2. Thus, the lower cylindrical member 2 is moved upwardly against the urge of the return spring 12 and the pressure of the liquid contained in the pressurized chamber (A) increases and the liquid is supplied to the liquid applicator means. When the rotation of the holder sleeve 6 is halted, the projections 10 are moved back to the recesses H by the return spring 12.

The seventh embodiment of the present invention is realized by modifying the means of engagement of the holder sleeve 6 and the lower cylindrical member 2 of the sixth embodiment. FIGS. 14 to 17 illustrate the seventh embodiment. In the seventh embodiment, an engaging groove 301' is formed on the outer surface of the lower cylindrical member 2 and a projection 304' is formed on the inner surface of the holder sleeve 6.

What is claimed is:

1. A liquid container comprising:

a holder sleeve;

a cylinder for forming a pressurized chamber, said cylinder being axially movable relative to said holder sleeve;

a cylinder cam means for causing said cylinder to move axially relative to said holder sleeve by rotating said holder sleeve relative to said cylinder;

projections provided on said cylinder, said projections being in contact with said cylinder cam means; and a push button means for moving said holder sleeve relative to said cylinder by pushing said push button means.

2. A liquid container comprising:

a container body having a barrel member, an axially slidable bottom cover positioned inside said barrel member;

a cylinder comprising a lower cylindrical member and an upper cylindrical member, said cylinder forming an axially movable pressurized chamber, said lower cylindrical member being provided with a suction valve at a lower end opening thereof, said lower cylindrical member being provided with at least one projection on an outer surface thereof, said lower cylindrical member being fitted to said container body, said upper cylindrical member having an outer cylindrical wall and an inner cylindrical wall respectively in contact with said outer surface of said lower cylindrical member and an inner surface of said lower cylindrical member, said upper cylindrical member being axially movable relative to said lower cylindrical member against a return spring provided between said lower cylindrical member and said upper cylindrical member, said upper cylindrical member and said lower cylindrical member having an axial groove-ridge engagement to prevent relative axial rotation between said upper cylindrical member and said lower cylindrical member;

a liquid applicator means provided at an upper end opening of said upper cylindrical member;

a discharge valve for closing an opening of said upper cylindrical member by pressing a valve body formed at a lower end of an axially deformable resilient body against a valve seat formed on an inner surface of said upper cylindrical member; and a holder sleeve rotatably fitted to an outer periphery of said outer cylindrical wall of said upper cylindrical member, said holder sleeve having an inward flange on an inner surface thereof, said inward flange having an undulated surface and being in contact with said projection.

3. The liquid container according to claim 2, wherein one or more longitudinal ridges are formed on the inner surface of the lower cylindrical member and a number of longitudinal grooves equal to the amount of said one or more longitudinal grooves are formed on an outer surface of said inner cylindrical wall of the upper cylindrical member, said longitudinal ridges being engaged with said longitudinal grooves.

4. The liquid container according to claim 2, wherein one or more longitudinal grooves are formed on the inner surface of the lower cylindrical member and a number of longitudinal ridges equal to the amount of said one or more longitudinal grooves are formed on an outer surface of said inner cylindrical wall of the upper cylindrical member, said longitudinal ridges being engaged with said longitudinal grooves.

5. A liquid container comprising:

a container body having a barrel member, an axially slidable bottom cover positioned inside said barrel member;

a cylinder comprising a lower cylindrical member and an upper cylindrical member, said cylinder forming an axially movable pressurized chamber, said lower cylindrical member being provided with a suction valve at a lower end opening thereof, a projection on an outer surface of said lower cylindrical member, said lower cylindrical member also having a downward-facing step having teeth, said lower cylindrical member being fitted to said container body;

said upper cylindrical member having an outer cylindrical wall and an inner cylindrical wall respectively in contact with the outer surface and an inner surface of said lower cylindrical member, said upper cylindrical member being axially movable relative to said lower cylindrical member against a return spring provided between said lower cylindrical member and said upper cylindrical member, said upper cylindrical member having a longitudinal groove engaged with said projection;

a liquid applicator means provided at an upper end opening of said upper cylindrical member;

a discharge valve for closing an opening of said upper cylindrical member by pressing a valve body formed at a lower end of an axially deformable resilient body against a valve seat formed on an inner surface of said upper cylindrical member; and a holder sleeve rotatably fitted to an outer periphery of the outer cylindrical wall of said upper cylindrical member, said holder sleeve having teeth on an inner surface thereof, said teeth being engaged with said teeth of the lower cylindrical member.

6. A liquid container comprising:

a container body having a barrel member, an axially slidable bottom cover positioned inside of said barrel member;

a cylinder comprising a lower cylindrical member and an upper cylindrical member, said cylinder forming an axially movable pressurized chamber, said lower cylindrical member being provided with a suction valve at a lower end opening thereof, a projection on an outer surface thereof, and a downward-facing step having an undulated and radially curved surface;

said upper cylindrical member having an outer cylindrical wall and an inner cylindrical wall respectively in contact with the outer surface and an inner surface of said lower cylindrical member, said upper cylindrical member being axially movable relative to said lower cylindrical member against a return spring provided between said lower cylindrical member and said upper cylindrical member, said upper cylindrical member having a longitudinal groove engaged with said projection;

in liquid applicator means provided at an upper end opening of said upper cylindrical member;

a discharge valve for closing an opening of said upper cylindrical member by pressing a valve body formed at a lower end of an axially deformable resilient body against a valve seat formed on an inner surface of said upper cylindrical member; and a holder sleeve rotably fitted to an outer periphery of the outer cylindrical wall of said upper cylindrical member, said holder sleeve having a projection engaged with said undulated surface.

7. A liquid container comprising:

a container body having a barrel member, an axially slidable bottom cover positioned inside of said barrel member;

a cylinder comprising a lower cylindrical member and an upper cylindrical member, said cylinder forming an axially movable pressurized chamber, said lower cylindrical member being provided with a suction valve at a lower end opening thereof, a projection on an outer surface thereof, and a downward-facing step having a projection;

said upper cylindrical member having an outer cylindrical wall and an inner cylindrical wall respectively in contact with the outer surface and an inner surface of said lower cylindrical member, said upper cylindrical member being axially movable relative to said lower cylindrical member against a return spring provided between said lower cylindrical member and said upper cylindrical member, said upper cylindrical member having a longitudinal groove engaged with said projection;

a liquid applicator means provided at an upper end opening of said upper cylindrical member;

a discharge valve for closing an opening of said upper cylindrical member by pressing a valve body formed at a lower end of an axially deformable resilient body against a valve seat formed on an inner surface of said upper cylindrical member; and a holder sleeve rotatably fitted to an outer periphery of the outer cylindrical wall of said upper cylindrical member, said holder sleeve having an undulated surface engaged with said projection.

8. A liquid container comprising:

a container body having a barrel member, an axially slidable bottom cover positioned inside said barrel member;

a cylinder comprising a lower cylindrical member and an upper cylindrical member, said cylinder forming an axially movable pressurized chamber, said lower cylindrical member being provided with a suction valve at a lower end opening thereof, and a projection on an outer surface thereof;

said upper cylindrical member having an outer cylindrical wall and an inner cylindrical wall respectively in contact with the outer surface and an inner surface of said lower cylindrical member, said upper cylindrical member being axially movable relative to said lower cylindrical member against a return spring provided between sand lower cylindrical member and said upper cylindrical member, said upper cylindrical member being rotatable relative to said lower cylindrical member, said outer cylindrical wall having an engagement window, said engagement window having a radially inclined lower edge, said lower edge being engaged with said projection;

a liquid applicator means provided at an upper end opening of said upper cylindrical member;

a discharge valve for closing an opening of said upper cylindrical member by pressing a valve body formed at lower end of an axially deformable resilient body against a valve seat formed on an inner surface of said upper cylindrical member; and a holder sleeve rotatably fitted to an outer periphery of the outer cylindrical wall of said upper cylindrical member, said holder sleeve being axially slidable relative to, but not rotatable with, said lower cylindrical member by a longitudinal engagement.

9. The liquid container according to claim 8, wherein said lower cylindrical member is provided with a downward-facing step having an engaging member, said holder sleeve is provided with a flange projected from an inner peripheral surface thereof, and said flange has a groove engaged with said engaging member.

10. The liquid container according to claim 8, wherein said holder sleeve is provided with an engaging member on an inner peripheral surface thereof, and said lower cylindrical member is provided with a downward-facing step having a groove engaged with said engaging member.

* * * * *